US007362201B2

(12) United States Patent
Saegusa et al.

(10) Patent No.: US 7,362,201 B2
(45) Date of Patent: Apr. 22, 2008

(54) INDUCTANCE DEVICE AND MANUFACTURING METHOD THEREOF

(75) Inventors: Seiichiro Saegusa, Yonezawa (JP); Hitoki Nakaya, Sakura (JP); Takayuki Ochi, Yonezawa (JP)

(73) Assignee: Yonezawa Electric Wire Co., Ltd., Yonezawa-Shi, Yamagata-Ken (JP)

( * ) Notice: Subject to any disclaimer, the term of this patent is extended or adjusted under 35 U.S.C. 154(b) by 71 days.

(21) Appl. No.: 11/221,131

(22) Filed: Sep. 7, 2005

(65) Prior Publication Data

US 2007/0052510 A1 Mar. 8, 2007

(51) Int. Cl.
*H01F 27/02* (2006.01)

(52) U.S. Cl. ..... 336/90; 336/92; 336/96

(58) Field of Classification Search ..... 336/90, 336/92, 96

See application file for complete search history.

(56) References Cited

U.S. PATENT DOCUMENTS 4,082,916 A * 4/1978 Jaklic et al. ..... 174/524
5,138,292 A * 8/1992 Forster ..... 335/278
2005/0007232 A1* 1/2005 Ono et al. ..... 336/213
2005/0012581 A1* 1/2005 Ono et al. ..... 336/90
2005/0030141 A1* 2/2005 Barber et al. ..... 336/96

FOREIGN PATENT DOCUMENTS

| | | |
|---|---|---|
| JP | H7-307236 | 11/1995 |
| JP | H2-285614 | 11/1996 |
| JP | H9-306715 | 11/1997 |
| JP | 10-199730 | 7/1998 |
| JP | 10-241969 | 9/1998 |
| JP | 2000-150244 | 5/2000 |
| JP | 2000-294429 | 10/2000 |
| JP | 2001-035723 | 2/2001 |
| JP | 2001-274029 | 10/2001 |
| JP | 2001-345225 | 12/2001 |
| JP | 2002-359118 | 12/2002 |
| JP | 2006-4957 | 1/2006 |

* cited by examiner

*Primary Examiner*—Anh Mai
(74) *Attorney, Agent, or Firm*—Hoffmann & Baron, LLP

(57) ABSTRACT

An inductance device has a hollow center coil around which a conducting wire is wound so that a hollow portion is formed along a center axis line of the hollow center coil, a filler which is filled into the hollow portion of the hollow center coil, and includes magnetic powder or a compound including the magnetic powder, and an accommodation case which accommodates the hollow core coil and has a bottom, wherein the filler is filled into the accommodation case.

6 Claims, 7 Drawing Sheets

INDUCTANCE DEVICE AND MANUFACTURING METHOD THEREOF

BACKGROUND OF THE INVENTION

1. Field of the Invention

The present invention relates to an inductance device which is properly used as a choking coil, an inductor, or the like, and a manufacturing method thereof.

2. Description of Related Art

Conventionally, as a choking coil, art is known in which a coil is wound around a center core (drum core) which is composed of a magnetic material such as a ferrite, or the like, and a side case (accommodation case) is arranged around the center core (see, for example, Patent Document 1: Japanese Unexamined Patent Application, First Publication No. H10-199730, Patent Document 2: Japanese Unexamined Patent Application, First Publication No. H10-241969, Patent Document 3: Japanese Unexamined Patent Application, First Publication No. 2000-150244, Patent Document 4: Japanese Unexamined Patent Application, First Publication No. 2001-35723, and Patent Document 5: Japanese Unexamined Patent Application, First Publication No. 2001-345225).

As the manufacturing method of such a choking coil, for example, methods as described below are used.

(1) A hollow center coil in which a conducting wire is wound so as to form a hollow portion along a center axis line is inserted into the center core, and the center core into which the hollow center coil is inserted is attached to the side case.

(2) The coil is formed by winding the conducting wire around an outer periphery of the center coil, and the center core around which the coil is wound is attached to the side case.

However, in method (1), when the hollow center coil is inserted into the center core, it is difficult for the hollow center coil to be attached exactly to the outer periphery (side surface) of the center core, so that there is a problem in which an air gap (clearance) tends to inevitably arises between the center core and the coil. Therefore, it is difficult to avoid decreasing the efficiency (performance) of the coil due to the air gap. Moreover, in order to manufacture the coil with the core, two processes of the manufacturing process of the hollow center coil and the insertion process for the center core are needed, which is inadequacy in view of workability.

Moreover, in method (2), in order to wind the coil around the periphery of the center core, it is necessary to rotate the center core with supporting it on its axis. Because of this requirement, a special manufacturing apparatus is needed and productivity of the coil is decreased. Moreover, when the center core has a shape such as a square sleeve shape having plane surface portions on the side surfaces, although the conducting wire which is wound around the center core contacts a ridgeline of the center core, the conducting wire extends in a round shape toward the outside at the plane surface portions, to generate air gaps (clearances) between the center core and the coil. Therefore, it is difficult to avoid decreasing the efficiency (performance) of the coil due to the air gap.

Moreover, because a core which consists of ferrite is very fragile and easily broken, careful handling is required, and a problem occurs in which productivity or yield is decreased.

Incidentally, in an inductance device which is used as a choking coil, an inductor, or the like, a ferrite core or a powder pressed core is conventionally used as the wound core (center core) of the coil, a case (ring core such as a pot shaped core, or the like) in which the coil is accommodated, or the like.

Among these, a powder pressed core can be obtained by a method in which magnetic powder is mixed with binder resin, and press molding is performed using a metal mold, or the like (see, for example, Patent Document 6: Japanese Unexamined Patent Application, First Publication No. 2001-274029).

However, in order to perform the press powder molding of the core, it is necessary to perform the press molding at considerably high temperature and high pressure. Therefore, a problem occurs in which manufacturing equipment becomes large in size, and expense and cost increase.

Moreover, the inductance device needs to be manufactured so that quality (inductance, and the like) is maintained within the range of a predetermined allowable error according to the use, the purpose, or the like thereof. When a powder pressing process is included in the manufacturing method of the inductance device, performing press molding of a formation including the magnetic powder and the binder with high temperature and high pressure may cause quality of the inductance device to change, and disparity of quality of the product to become higher. It is, therefore, difficult to manufacture products of which disparity of quality is small and precision is high, and thereby a problem occurs in which yield is decreased and cost is increased.

SUMMARY OF THE INVENTION

The present invention has been carried out in view of the above-mentioned circumstances, and offers an inductance device which can be manufactured so that disparity of quality becomes low, in which the air gap between the core and the coil can be eliminated, and productivity is excellent. The present invention also offers a manufacturing method thereof.

The present invention is an inductance device having a hollow center coil around which a conducting wire is wound so that a hollow portion is formed along a center axis line of the hollow center coil, and filler which is filled into the hollow portion of the hollow center coil, and includes magnetic powder or a compound including the magnetic powder.

According to the present invention, because the filler functions as a center core, as the case may be, as a ring core, a conventional center core, or the like is not needed, and thereby, as compared with the conventional constitution, the inductance device can be easily manufactured. Moreover, because the formation of the hollow core coil is not dependant on the formation of the center core, or the like, the degree of freedom of the formation of the hollow core coil can be improved. Because a process is not needed in which the center core is inserted into the hollow core coil, workability is improved. Moreover, the air gap between the core and the hollow core coil can be eliminated.

Moreover, according to the present invention, because a center core, or the like is not needed, for example, a powder pressing molding of the core is not needed, disparity of quality (inductance, or the like) is decreased, and thereby an inductance device which has quality required by the use, the purpose, or the like thereof can be easily manufactured. Therefore, yield can be improved, and cost can be decreased.

The inductance device of the present invention may include an accommodation case which accommodates the hollow core coil and has a bottom, and the filler may be filled into the accommodation case.

According to the present constitution, assembly of the inductance device can be easily carried out.

In the present invention, the accommodation case may be made of magnetic material or metal.

According to the above constitution, high shielding effects can be obtained. Especially, when a solenoid type of coil of which the magnetic path is open is used, the above constitution is effective.

In the present invention, the filler may have an auto-melting nature film at an outer periphery thereof, and the filler may be melted together due to auto-melting of the auto-melting nature film.

In the present invention, the accommodation case may have an opening portion, and the opening portion may be sealed by a copper laminated plate.

In the present invention, the accommodation case may have an opening portion, and the opening portion may be sealed by potting material.

In the present invention, the accommodation case may have an opening portion, and the opening portion may be sealed by a metal plate.

In the present invention, the accommodation case may have an opening portion, and the opening portion may be sealed by an insulative substrate.

The present invention provides a manufacturing method of an inductance device comprising: a step of accommodating a hollow core coil in an accommodation case, and a step of filling in filler including magnetic powder or a compound including the magnetic-powder into the accommodation case.

DETAILED DESCRIPTION OF THE INVENTION

A first embodiment of the present invention will be explained with reference to the figures.

Figure 1:
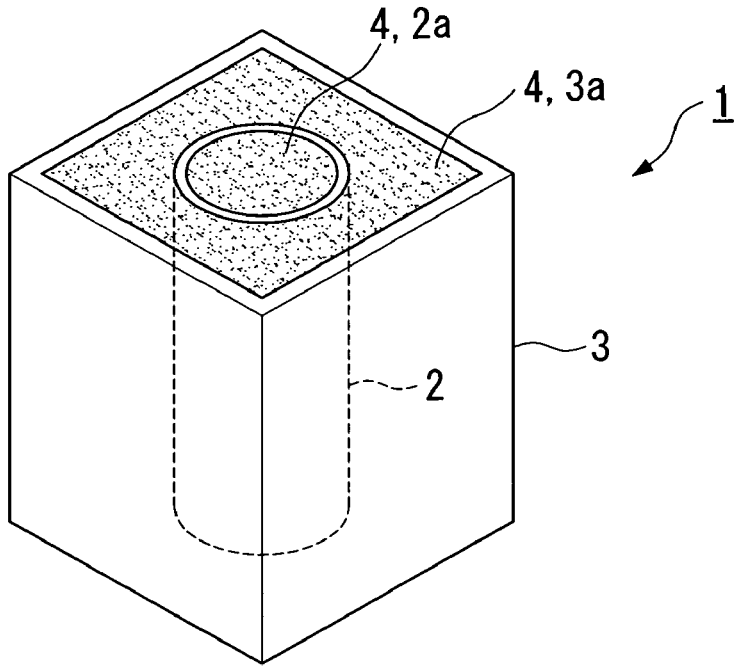
FIG. 1 is a perspective view showing an embodiment of a choke coil (inductance device) of the present invention.
Figure 2:
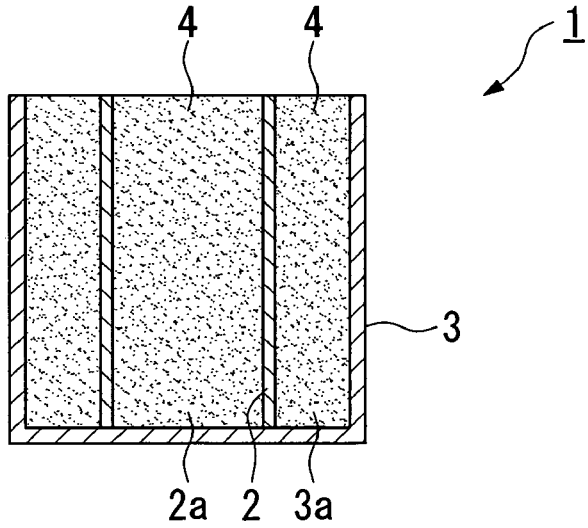
FIG. 2 is a vertical cross-sectional view of the choke coil shown in FIG. 1.

As shown in FIG. 1 and FIG. 2, in a choke coil (inductance device) 1 of the present invention, a hollow core coil 2 is arranged in a side case (accommodation case) 3 which is made of magnetic material. Filler 4 which is magnetic powder or a compound including the magnetic powder is filled into a hollow portion 2*a* of the hollow core coil 2 and the side case 3.

The hollow core coil 2 may be formed by winding a conducting wire so that the hollow portion 2*a* is formed along a center axis line, and the hollow core coil 2 may be formed as a bottomed shape, a tetragonal cylindrical shape, or any other shape. The center axis line of the hollow core coil 2 is not limited to a straight line, and may be a curved line such as an S-shaped line, or the like.

If necessary, both terminals of the conducting wire which constitutes the hollow core coil 2 may be connected to terminal portions (not shown in the figures). Moreover, the terminals of the hollow core coil 2 may be used as a lead line, the terminals of the hollow core coil 2 may be connected to an external circuit via a surface mounting terminal which is mounted on a substrate, and various other constitutions can be adopted.

Figure 4:
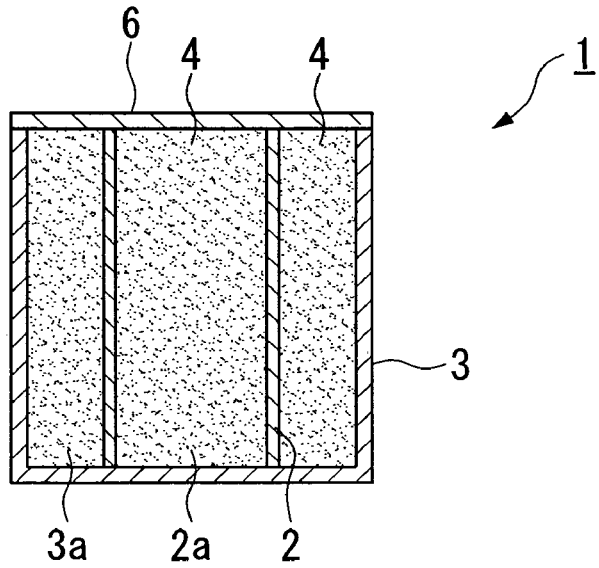
FIG. 4 is a vertical cross-sectional view showing a modified example of the choke coil of the present invention.

As long as the side case 3 is made of magnetic material, is formed as a bottomed shape which has a bottom, and has an internal space 3*a* in which the filler 4 (magnetic powder or a compound including the magnetic powder) can be filled, the constitution of the side case 3 is not limited at all. In view of magnetic shielding, material whose coercive force is small may be desirably used as the side case 3. As the material having small coercive power, iron nickel alloy (permalloy), or the like is exemplary. As shown in FIG. 4, an opening portion of the side case 3 may be sealed by a proper sealing material 6 (a lid, or the like).

As the magnetic powder, for example, ferrite powder such as Mg ferrite, Cu—Zn ferrite, or the like can be used. Moreover, the magnetic powder may be malleable iron powder (soft magnetic powder). As the compound including the magnetic powder, for example, a compound in which adhesive (binder) such as thermosetting resin, or the like is mixed into the above-mentioned magnetic powder can be used. As synthetic resin which can be used as the binder, epoxy resin, silicone resin, or the like can be used.

In the above compound, the mixing ratio of magnetic powder and binder is not especially limited. However, when the opening portion of the side case 3 is not sealed, the mixing ratio may be adopted so that the magnetic powder is bound to an extent at which the magnetic powder does not spill out from an inside of the side case 3. As shown in FIG. 4, when the opening portion of the side case 3 is sealed by the lid 6, or the like, the binder is not used, and the magnetic powder only may be filled.

According to the choke coil 1 which is so obtained, because the filler 4 which is the magnetic powder or the compound including the magnetic powder is filled into the inside and outside of the hollow core coil 2, each can function as the center core or the ring core. Therefore, as compared with the conventional constitution, the choke coil can be easily manufactured. Because the process can be omitted in which the center core is inserted into the hollow core coil, workability can be improved.

Figure 3:
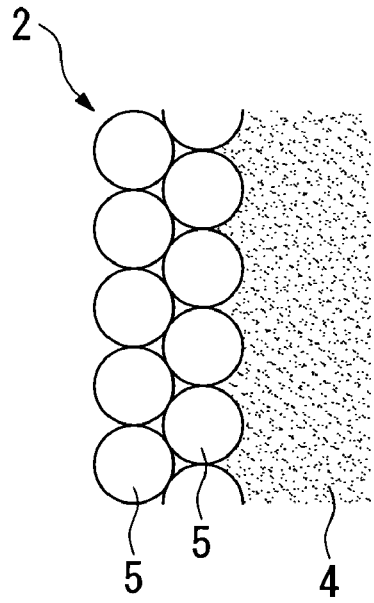
FIG. 3 is a partial enlarged view of the choke coil shown in FIG. 1.

Moreover, as shown in FIG. 3, because the filler 4 which is the magnetic powder or the compound is filled so that the filler 4 is attached to the conducting wire 5 of the hollow core coil 2, the air gap between the core and the coil can be eliminated.

Because a ready-made core does not need to be prepared, and the core can be formed according to the coil shape, the degree of freedom of design of the coil shape can be improved. Therefore, a choke coil in which space-saving is achieved due to miniaturization, or various products according to various usages can be provided.

As the manufacturing method of the first embodiment of the present invention, the hollow core coil 2 is accommodated in the side case 3, then, the filler which is the magnetic powder or the compound including the magnetic powder is filled into the side case 3. If necessary, the filler 4 is pressed in order to increase the density of the filler 4. Then, the opening portion of the side case 3 is sealed by the sealing material (lid). Thereby, the inductance device according to the first embodiment of the present invention can be obtained.

Next, a second embodiment of the present invention will be explained with reference to the figures.

Figure 8:
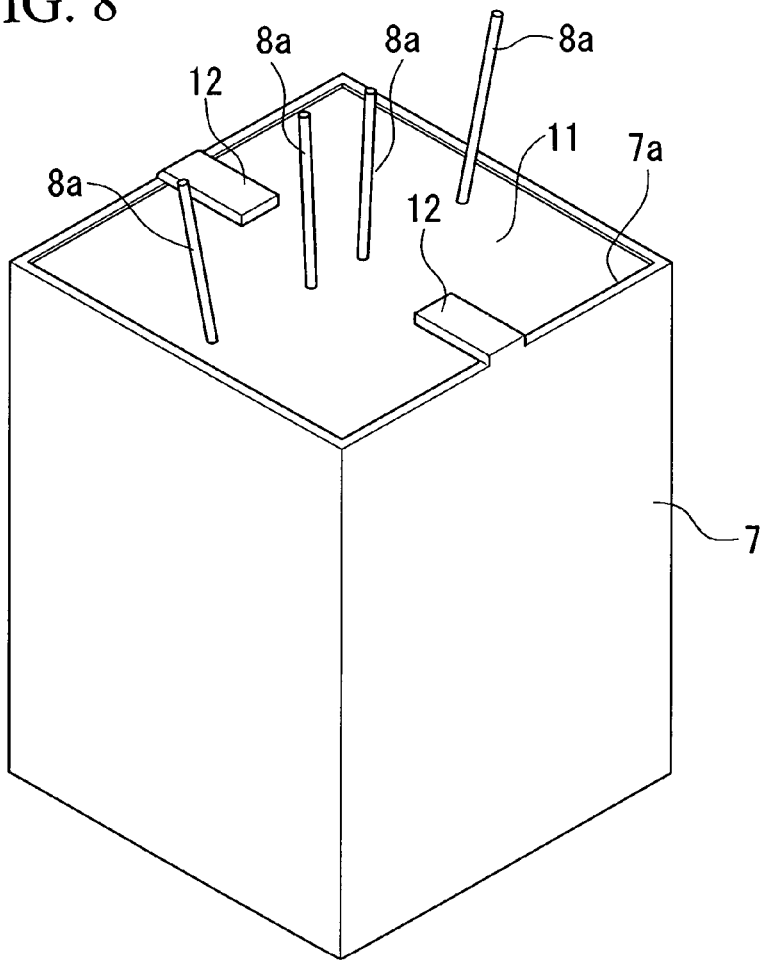
FIG. 8 is a view explaining an example of a manufacturing process of an inductance device of the present invention.
Figure 9:
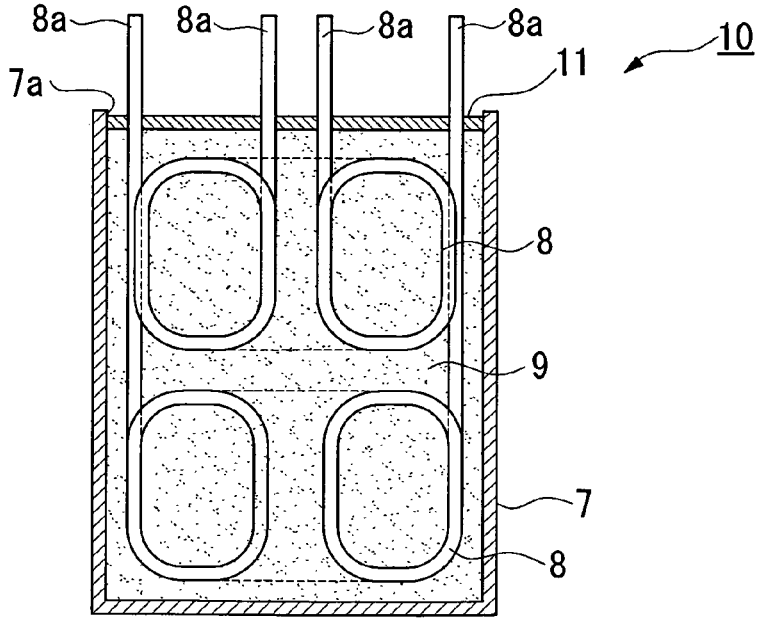
FIG. 9 is a cross-sectional view showing an embodiment of the inductance device of the present invention.

As shown in FIGS. 8 and 9, an inductance device 10 according to the present embodiment is provided with a metal case 7 (accommodation case) (hereinafter, occasionally, it is merely described as "case"), and hollow core coils 8 which are accommodated in this case 7. Furthermore, magnetic powder (filler) 9 is filled into the case 7.

The metal case 7 has a bottomed shape (rectangular shape) which has a bottom and has an opening portion toward an upper part. The opening portion 7*a* of the case 7 is sealed by a sealing material such as a copper laminated plate, potting material, a metal plate, an insulative substrate, or the like.

A plurality of tongue pieces 12 project from an edge of the opening portion 7*a* of the case 7. As shown in FIG. 8, the tongue pieces 12 are bent toward an inside of the opening portion 7*a* of the case 7, and the tongue pieces 12 press the sealing material 11, thereby preventing the sealing material 11 from coming out.

Regarding qualities of the material of the metal case 7, because copper (high purity copper), brass, aluminum, or the like has excellent electroconductivity and excellent magnetic shielding properties, these materials may be used. Moreover, metal such as iron, permalloy, or the like may be used.

As compared with the case in which the coil is accommodated in a pot shaped core which is made of ferrite, or the like, the case is made of metal such as copper, copper alloy, or the like, mechanical properties such as intensity, shock resistance, or the like are improved. It is, therefore, easy for wall thickness to be thin, and magnetic shielding (electromagnetic wave shielding) can be performed. Moreover, price can be made cheap.

Although the number or the structures of the hollow core coils 8 is not especially limited, proper constitutions can be adopted according to the use, the purpose, or the like, and in this case, two toroidal coils are used. In this case, for example, the inductance device 10 can be used as a low pass filter for a digital amplifier, or the like.

Although the nature of the material and the cross-sectional shape of the conducting wire which constitutes the coil are not especially limited, for example, a circular line, a straight angle line, or the like in the cross-sectional view which is made of a good conductor such as copper, or the like is adopted. Both terminal portions 8*a* of the hollow core coils 8 protrude from the outside of the opening portion 7*a* of the case 7. If necessary, terminals (not shown in the figures) may be connected to the terminal portions 8*a* of the hollow core coils 8.

Although the nature of the material of the magnetic powder 9 is not especially limited, for example, powder of a magnetic material such as ferrite, or the like can be used. As the above-mentioned ferrite, Mn—Zn ferrite, Ni—Zn ferrite, Mg-ferrite, Cu—Zn ferrite, or the like, is used. Moreover, the magnetic powder may be malleable iron powder (soft magnetic powder). Permalloy, or the like is suitable as the magnetic powder.

Moreover, as the magnetic powder 9, a magnetic powder having an auto-melting nature film can be used. As the magnetic powder having an auto-melting nature film, for example, a magnetic powder is used in which a film which shows an auto-melting nature when heated is thinly and uniformly formed on the outside surface of a magnetic powder such as ferrite, iron (for example, carbonyl), or the like. As the auto-melting nature film, thermoplastic resin which has a thermo melting nature such polypropylene, acrylics, polyurethane, or the like can be used. When these resin films are formed, for example, the auto-melting of the particles can be performed by heating from 150° C. to 180° C. In the case of auto-melting, pressurization is not needed, so the manufacturing can be performed under normal pressure.

The thickness of the auto-melting nature film is preferably 1 μm or less. Thereby, the ratio of the magnetic powder in the case 7 can be made high, and more excellent closed magnetic path properties can be obtained. The diameter of the particles of the magnetic powder is desirably 50 μm to 200 μm.

When the magnetic powder having an auto-melting nature film is used, even if the magnetic material has electrical conductivity, the magnetic material is electrically insulated from the case 7 and the coils 8 by the auto-melting nature film. Therefore, when the case is grounded, inconvenience such as a short circuit, or the like is prevented from occurring.

As the sealing material 11, for example, potting material such as silicone, a copper laminated plate in which copper foil is applied to a side surface or both surfaces of a substrate (for example, a laminated plate such as a glass cloth base epoxy resin substrate, or the like), a metal plate such as a copper plate, a brass plate, an aluminum plate, or the like, or an insulative substrate can be used. When, for example, such with the copper laminated plate, the copper plate, the brass plate, or the like, a plate material having a metal layer of which electrical conductivity is high is used as the sealing material 11, the magnetic shielding properties including direction of the opening portion 7*a* of the case 7 can be secured. Leakage flux is therefore decreased, and thereby properties of the inductance device can be improved more.

When the sealing material 11 is a plate shape, an inserting hole (not shown in the figures) for inserting the terminal portions 8*a* of the hollow core coils 8 can be formed. In this case, because the terminal portions 8*a* of the hollow core coils 8 can be positioned with respect to the inserting hole, the positions of the terminal portions 8*a* can be easily adjusted.

When the sealing material 11 is a copper laminated plate and the terminal portions 8*a* of the hollow core coils 8 are used as the lead, it is not necessary for the terminal portions 8*a* of the hollow core coils 8 to be electrically connected to the copper foil.

When wiring is provided by pattern formation of the copper foil layer of the copper laminated plate, and wiring is provided, the terminal portions 8*a* of the hollow core coils 8 can be electrically connected to the wiring. In this case, the wiring of the copper laminated plate can be used as the lead of the inductance device.

Next, an example of a manufacturing method of the inductance device 10 of the present embodiment will be explained.

Figure 5:
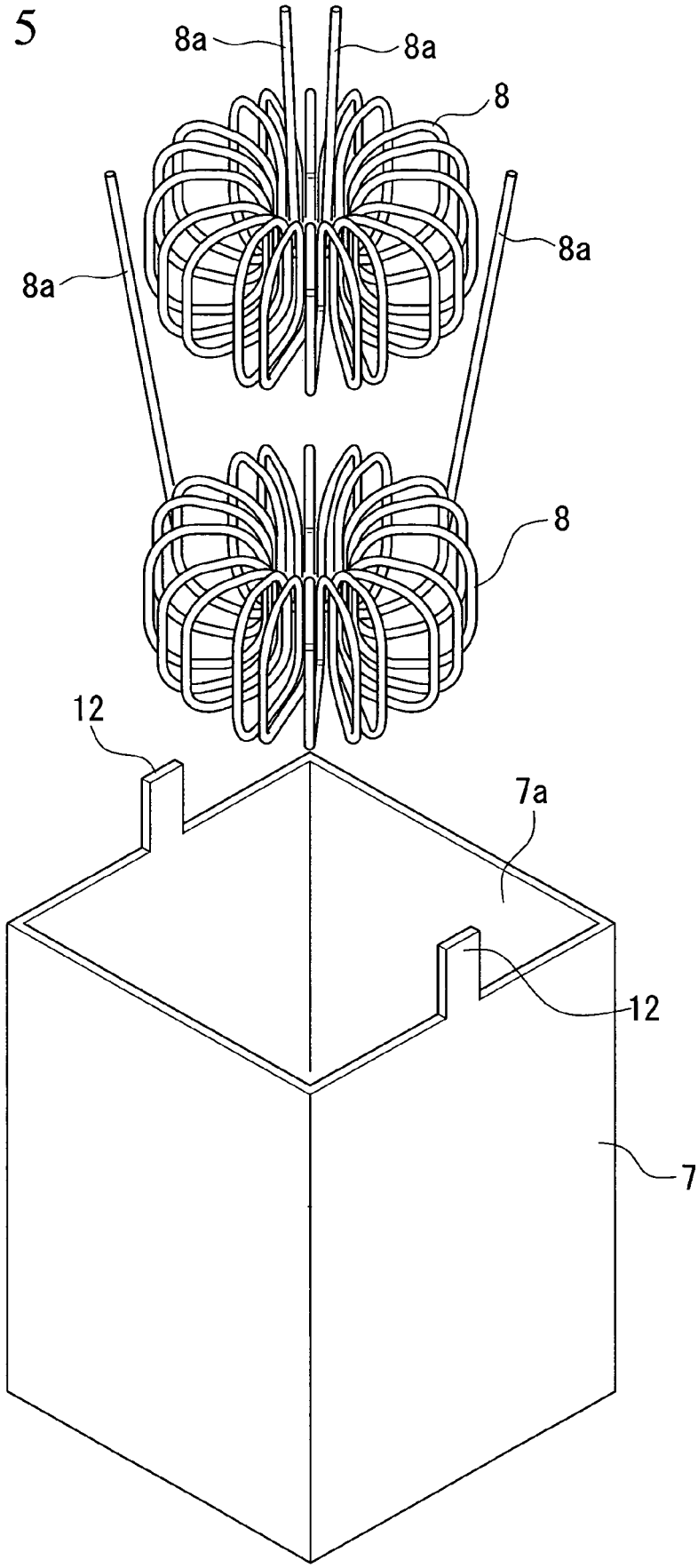
FIG. 5 is a view explaining an example of a manufacturing process of an inductance device of the present invention.
Figure 6:
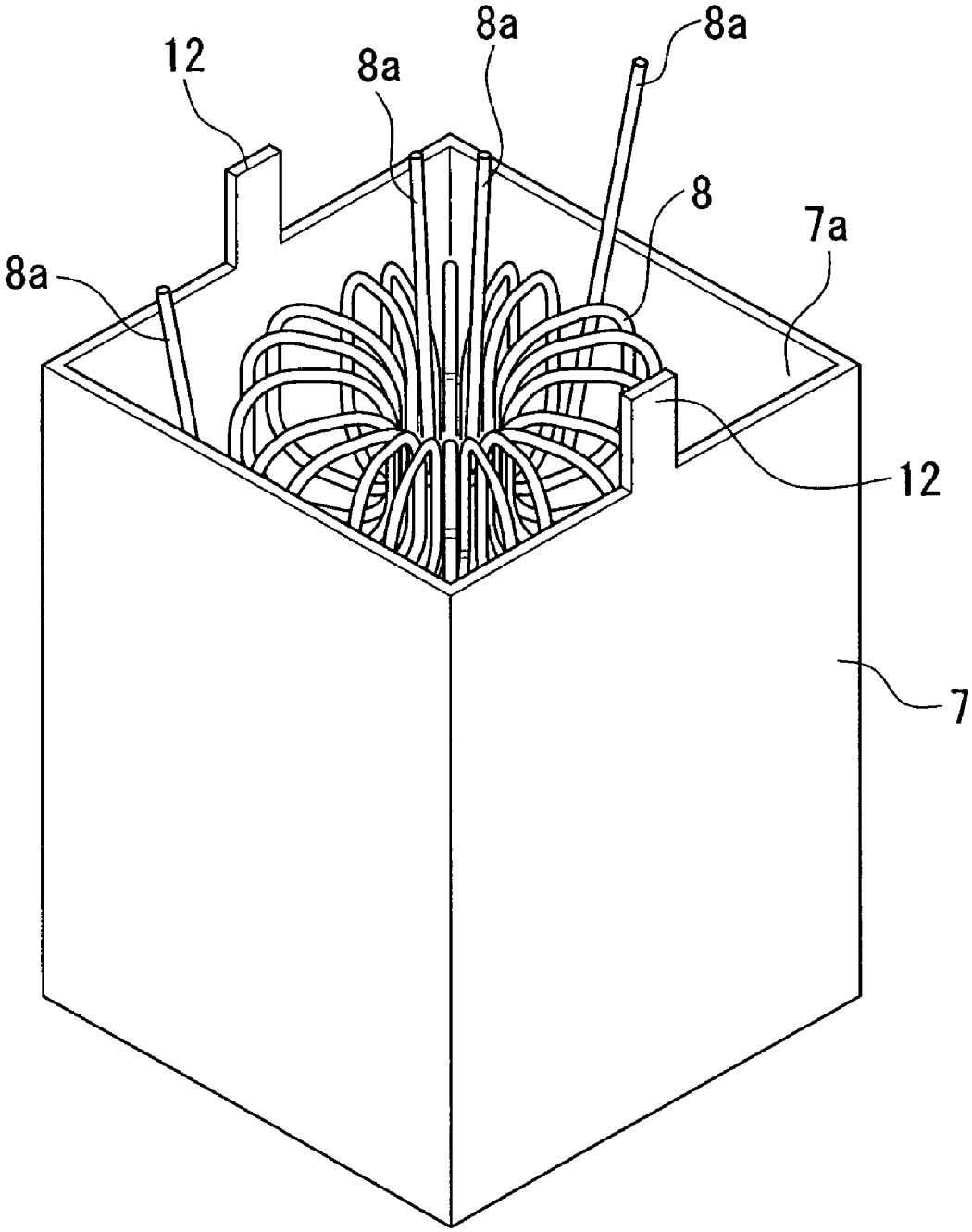
FIG. 6 is a view explaining an example of a manufacturing process of an inductance device of the present invention.

First, as shown in FIGS. 5 and 6, the hollow core coils 8 are put into the case 7 from the opening portion 7*a* of the case 7, and the hollow core coils 8 are accommodated in the case 7. In this case, the terminal portions 8*a* of the hollow core coils 8 protrude from the case 7. Here, two hollow core coils 8 are collocated at an upper side and a lower side of the case 7. The length of parts protruding from the terminal portions 8*a* of the hollow core coil 8 from the lower side is longer than that of the hollow core coil at the upper side so that the terminal portions 8*a* of the hollow core coils 8 protrude from the outside of the case 7.

In addition, the terminal portions 8*a* of the hollow core coils 8 are set a little longer than needed, and then, unnecessary parts of the terminal portions 8*a* may be cut and removed afterward.

Figure 7:
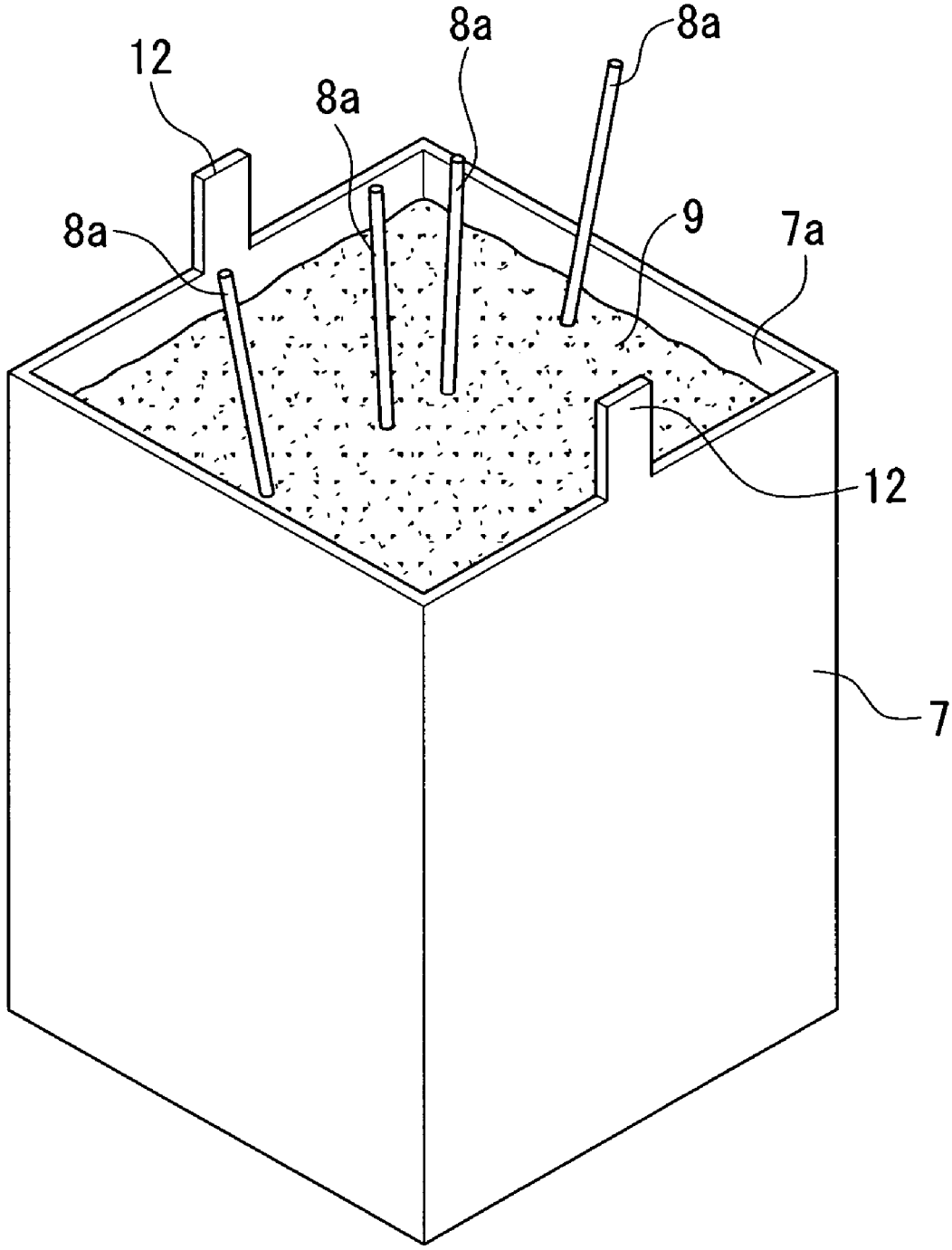
FIG. 7 is a view explaining an example of a manufacturing process of an inductance device of the present invention.

Next, as shown in FIG. 7, the magnetic powder 9 is put into the case 7, and the magnetic powder 9 is filled into the outside of the hollow core coil 8 and spaces between the conducting wires of the hollow core coils 8 in the case 7 without exception. When the magnetic powder 9 is filled, a measuring instrument such as an LRC meter, or the like is connected to the terminal portions 8*a* of the hollow core coils 8 to measure the inductance. The amount of filling of the magnetic powder 9 may be modified according to the value of the target inductance. Moreover, the value of the inductance can be adjusted by changing the particle diameter of the magnetic powder which is filled. When the filler 4 is a compound, the value of the inductance can be adjusted by changing the mixing ratio between the magnetic powder 9 and the binder. Moreover, the value of the inductance can be adjusted by changing the compression amount for the magnetic powder 9. Moreover, when the magnetic powder 9 is filled, the case 7 may be vibrated, the density of the magnetic powder 9 increased, and thereby the value of the inductance adjusted. After the magnetic powder 9 is filled, the magnetic powder 9 is heated in a heating furnace, thereby causing auto-melting of the magnetic powder 9. At this time, the value of the inductance can be adjusted by changing the heating conditions (heating temperature or heating time).

Furthermore, if necessary, the sealing material 11 is provided so that the opening portion 7*a* of the case 7 is covered. When the sealing is performed by potting, the potting material is coated, and the positioning of the terminal portions 8*a* of the hollow core coils 8 is corrected, and after that, the potting material is hardened, and the sealing is performed.

Moreover, when the sealing material 11 is a plate material, the sealing material 11 is arranged so that the sealing material 11 covers the opening portion 7*a* of the case 7, and after that, the sealing material 11 is fixed by bending the tongue pieces 12. Moreover, in order to fix the sealing material 11, adhesive, or the like may be used.

According to the above-mentioned inductance device and the manufacturing method thereof, the amount of filling and the particle diameter of the magnetic powder can be individually and easily adjusted, and an inductance device can be obtained in which disparity of quality (inductance, or the like) is decreased. Therefore, yield can be improved, and cost can be also decreased.

Because five faces out of six faces surrounding the magnetic powder are surrounded by the metal case, shielding of a magnet from the coil can be performed. Furthermore, when the opening portion of the case is sealed by a sealing material having a metal layer of which the electrical conductivity is high, magnetic shielding can be performed for all six faces surrounding the magnetic powder. Therefore, leakage flux is decreased, and an inductance device of which properties are more excellent can be obtained. When the inductance device according to the present invention is used, it is possible to prevent other parts in an electronic apparatus having the inductance device thereof from being interfered with, or the inductance device interfering with devices outside of the electronic apparatus.

Because the magnetic powder is filled into the inside and the outside of the hollow core coil, each of them functions as the center core or the ring core, and a closed magnetic path can be constituted. Therefore, an inductance device of which properties are excellent can be obtained.

Because a ready-made core is not needed, and the core can be formed according to coil shape, degree of freedom of the design of the coil shape can be improved. Therefore, an inductance device in which space-saving is achieved due to miniaturization, or various products according to various usages can be provided. Moreover, in a coil which is wound to form a lamination layer such as a solenoid coil, the magnetic powder enters into a gap between laminated copper wire, and thereby the properties can be improved.

Figure 10:
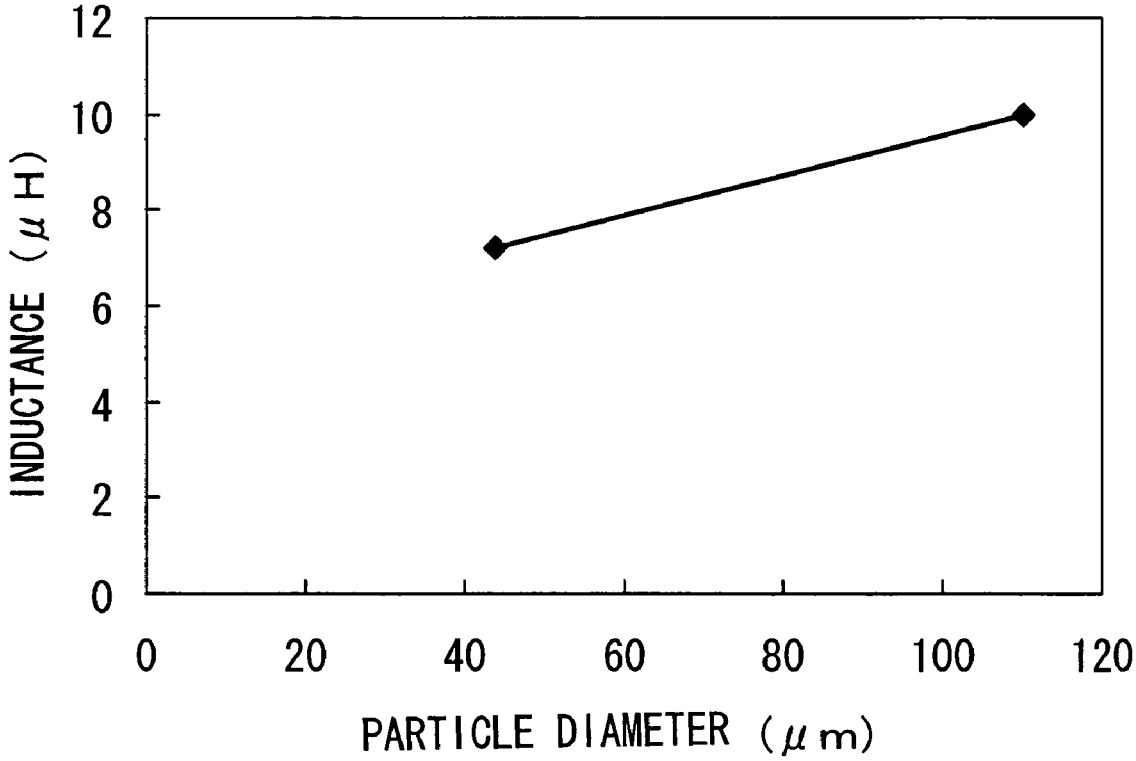
FIG. 10 is a graphical view showing an example of a relationship between a particle diameter of magnetic powder and inductance of the inductance device.

In FIG. 10, an example of a relationship between a particle diameter of magnetic powder and inductance of the inductance device is shown. Here, a copper case is used as the metal case, and Cu—Zn ferrite is used as the magnetic powder.

As will be understood from the result shown in FIG. 10, by changing the particle diameter of the magnetic powder which is filled, the value of the inductance can be easily adjusted.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

For example, the accommodation cases 3 and 7 are used in the present invention. However, because these accommodation cases 3 and 7 are used to contain the filler, and maintain the shape of the filler, when the resin is coated around the filler, or the surface resin layer is formed by resin molding, or the like, the accommodation cases 3 and 7 are not needed. Moreover, the binder can be attached only to the surface of the filler, and only the surface of the filler can be fixed (for example, by laser processing, or the like, only the surface of the filler is heated, and the inside of the filler is not heated). Because, in the present invention, it is not necessary for the powder to be fixed by heating and pressing, in the case of not using the accommodation case 3 or 7, the above-mentioned process is needed in order to maintain a external shape of the filler.

In the above-mentioned embodiment, an accommodation case made of a magnetic material or metal is used. However, such an accommodation case need not be used, and metal coating, or the like on the surface of the filler may be performed, and thereby shielding effects can be obtained.

Moreover, because the second embodiment of the present invention uses a toroidal type of coil, and has a closed magnetic path, an accommodation case for obtaining shielding effects is not needed. Therefore, an accommodation case made of resin can be used. Moreover, if the accommodation case is not used, the degree of freedom of the shape of the inductance device can be improved.

Moreover, when the filler is pressed, the density of the filler is increased, and the inductance is improved. Especially, the first embodiment of the present invention is a solenoid type of coil, and is suitable for being made high density by pressing. In contrast, the second embodiment of the present invention is a toroidal type of coil, and although high density due to pressing is not impossible, in the case of pressing, it is desirable for destruction and deformation of the coil not to occur.

Moreover, as mentioned above, while monitoring the properties of inductance, or the like using a meter connected to the hollow core coil, the hollow portion of the hollow core coil, or the like can be filled with the filler. Thereby, while confirming the properties, the hollow portion, or the like of the hollow core coil can be filled with the filler, as compared with the selection and the use of the hollow coil according to the target properties, and the properties can be simply and finely adjusted.

Moreover, together with the hollow core coil, other members such as a condenser, a resistor (resistance), or the like can be filled with the filler. By such a method, for example, an external part which is constituted as a low pass filter can be removed from the substrate, and the manufacturing of a complex product can be easily performed. Furthermore, in the state in which the hollow core coil and the other members are connected to each other, while being monitored by the meter, the hollow core coil and the other members can be filled with the filler, and thereby the properties thereof can be finely adjusted according to the density of the filler. In the present invention, because the filler can be fixed without being heated, or being heated at a low temperature, the other members such as the condenser, and the like can be embedded, and thereby the properties of the condenser, or the like can be maintained.

In addition, the inductance device of the present invention can be used as a filter, an inductor, or the like such as a choke coil, a low pass filter, or the like.

What is claimed is:

1. An inductance device comprising:

a hollow center coil including a conducting wire which is wound so that a hollow portion is formed along a center axis line of the hollow center coil;

a filler which is filled into the hollow portion of the hollow center coil, and includes magnetic powder or a compound including the magnetic powder, an accommodation case made from a magnetic iron nickel alloy material containing the hollow center coil, the accommodation case having a bottom and an opening opposite the bottom, and being filled with the filler, wherein the conducting wire of the hollow center coil is in direct contact with the filler;

a sealing material sealing the opening of the accommodation case; and at least one tongue piece provided at the opening of the accommodation case and bent inward against the sealing material for retaining the sealing material at the accommodation case opening.

2. An inductance device according to claim 1, wherein the filler has an auto-melting nature film at an outer periphery thereof, and the filler is melted together due to auto-melting of the auto-melting nature film.

3. An inductance device according to claim 1, wherein the accommodation case has an opening portion, and the opening portion is sealed by a copper laminated plate.

4. An inductance device according to claim 1, wherein the accommodation case has an opening portion, and the opening portion is sealed by potting material.

5. An inductance device according to claim 1, wherein the accommodation case has an opening portion, and the opening portion is sealed by a metal plate.

6. An inductance device according to claim 1, wherein the accommodation case has an opening portion, and the opening portion is sealed by an insulative substrate.

* * * * *